US009382094B2

(12) United States Patent
Nakamura et al.

(10) Patent No.: US 9,382,094 B2
(45) Date of Patent: Jul. 5, 2016

(54) ELEVATOR REFURBISHMENT METHOD

(75) Inventors: Hideki Nakamura, Tokyo (JP); Sachiomi Mizuno, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 198 days.

(21) Appl. No.: 14/007,210

(22) PCT Filed: Jun. 6, 2011

(86) PCT No.: PCT/JP2011/062914

§ 371 (c)(1),
(2), (4) Date: Sep. 24, 2013

(87) PCT Pub. No.: WO2012/168992

PCT Pub. Date: Dec. 13, 2012

(65) Prior Publication Data

US 2014/0013562 A1 Jan. 16, 2014

(51) Int. Cl.

| | |
|---|---|
| ***B66B 1/24*** | (2006.01) |
| ***B66B 11/00*** | (2006.01) |
| ***B66B 19/00*** | (2006.01) |
| ***B66B 11/04*** | (2006.01) |
| ***B66B 11/06*** | (2006.01) |
| ***B66B 11/02*** | (2006.01) |

(52) U.S. Cl.

CPC ..... *B66B 1/24* (2013.01); *B66B 11/0045* (2013.01); *B66B 11/0075* (2013.01); *B66B 11/0206* (2013.01); *B66B 11/0476* (2013.01); *B66B 11/06* (2013.01); *B66B 19/005* (2013.01); *B66B 19/007* (2013.01); *Y10T 29/49718* (2015.01)

(58) Field of Classification Search

CPC ..... Y10T 29/49716; Y10T 29/49718; B23P 6/00; B66B 1/24; B66B 11/0075; B66B 11/0045; B66B 19/005; B66B 11/0476; B66B 11/06; B66B 11/0206; B66B 19/007; B66B 1/06; B66B 7/06; B66B 7/08; B66B 9/04; B66B 9/0807

USPC ..... 29/402.01

See application file for complete search history.

(56) References Cited

U.S. PATENT DOCUMENTS

| | | | | |
|---|---|---|---|---|
| 7,775,325 | B2 * | 8/2010 | Liebetrau et al. | 187/254 |
| 8,407,876 | B2 * | 4/2013 | Fischer | 29/401.1 |
| 2011/0209318 | A1 * | 9/2011 | Fischer | 29/401.1 |

FOREIGN PATENT DOCUMENTS

| | | | |
|---|---|---|---|
| JP | 2010 105805 | | 5/2010 |
| JP | 2010 116231 | | 5/2010 |
| JP | 2010105805 | A * | 5/2010 |
| JP | 2010116231 | A * | 5/2010 |

OTHER PUBLICATIONS

International Search Report Issued Aug. 30, 2011 in PCT/JP11/062914 filed Jun. 6, 2011.

* cited by examiner

*Primary Examiner* — David Bryant
*Assistant Examiner* — Lawrence Averick
(74) *Attorney, Agent, or Firm* — Oblon, McClelland, Maier & Neustadt, L.L.P.

(57) ABSTRACT

An elevator renovation method, which is capable of reducing a renovation period and enabling effective use of a space when an existing hydraulic elevator is renovated to a non-hydraulic elevator. The elevator renovation method involves renovating a hydraulic elevator in which a plunger provided integrally with a car is hydraulically driven to a non-hydraulic elevator. The elevator renovation method includes; providing a driving device for generating a driving force for raising the car; leaving the plunger so that the plunger can be raised and lowered inside an existing jack; and obtaining the non-hydraulic elevator by exerting the driving force of the driving device in a direction in which the plunger is moved up to raise the car.

5 Claims, 24 Drawing Sheets

ELEVATOR REFURBISHMENT METHOD

TECHNICAL FIELD

The present invention relates to an elevator renovation method for renovating a hydraulic elevator to a non-hydraulic elevator.

BACKGROUND ART

An elevator includes a hoistway which extends vertically and a car which is provided so as to be movable in the hoistway. Conventionally, the renovation of a hydraulic elevator to a machine room-less rope elevator or a pressure-driven elevator has been carried out. An example of the renovation is now described. According to a method described in Patent Literature 1, when an old existing hydraulic elevator is to be renovated to a rope elevator, devices relating to the driving of the hydraulic elevator are first removed. Thereafter, devices of the rope elevator are installed in the hoistway.

According to the above-mentioned elevator renovation method, however, the removal of devices for the hydraulic elevator, which are provided in the hoistway, such as a jack and a plunger, takes time and efforts. Therefore, there is a problem in that a period of renovation work becomes disadvantageously long. Moreover, when a top part of the hoistway has no room for a space for providing a new hoisting machine and deflector sheave, and further a space for providing beams for supporting the hoisting machine and the deflector sheave, there is another problem in that the renovation is difficult.

CITATION LIST

Patent Literature
[PTL 1] 2010-105805 A

SUMMARY OF INVENTION

Technical Problems

The present invention has been made to solve the problems described above, and therefore has an object to provide an elevator renovation method, which is capable of reducing a renovation period and enabling effective use of a space when an existing hydraulic elevator is renovated to a non-hydraulic elevator.

Solution to Problems

In order to attain the object described above, according to the present invention, there is provided an elevator renovation method for renovating a hydraulic elevator in which a plunger provided integrally with a car is hydraulically driven to a non-hydraulic elevator, including; providing a driving device for generating a driving force for raising the car; leaving the plunger so that the plunger can be raised and lowered inside an existing jack; and obtaining the non-hydraulic elevator by exerting the driving force of the driving device in a direction in which the plunger is moved up to raise the car.

Advantageous Effects of Invention

According to the elevator renovation method of the present invention, it is possible to reduce the renovation period and enable the effective use of a space when the existing hydraulic elevator is renovated to the non-hydraulic elevator.

DESCRIPTION OF EMBODIMENTS

Figure 1:
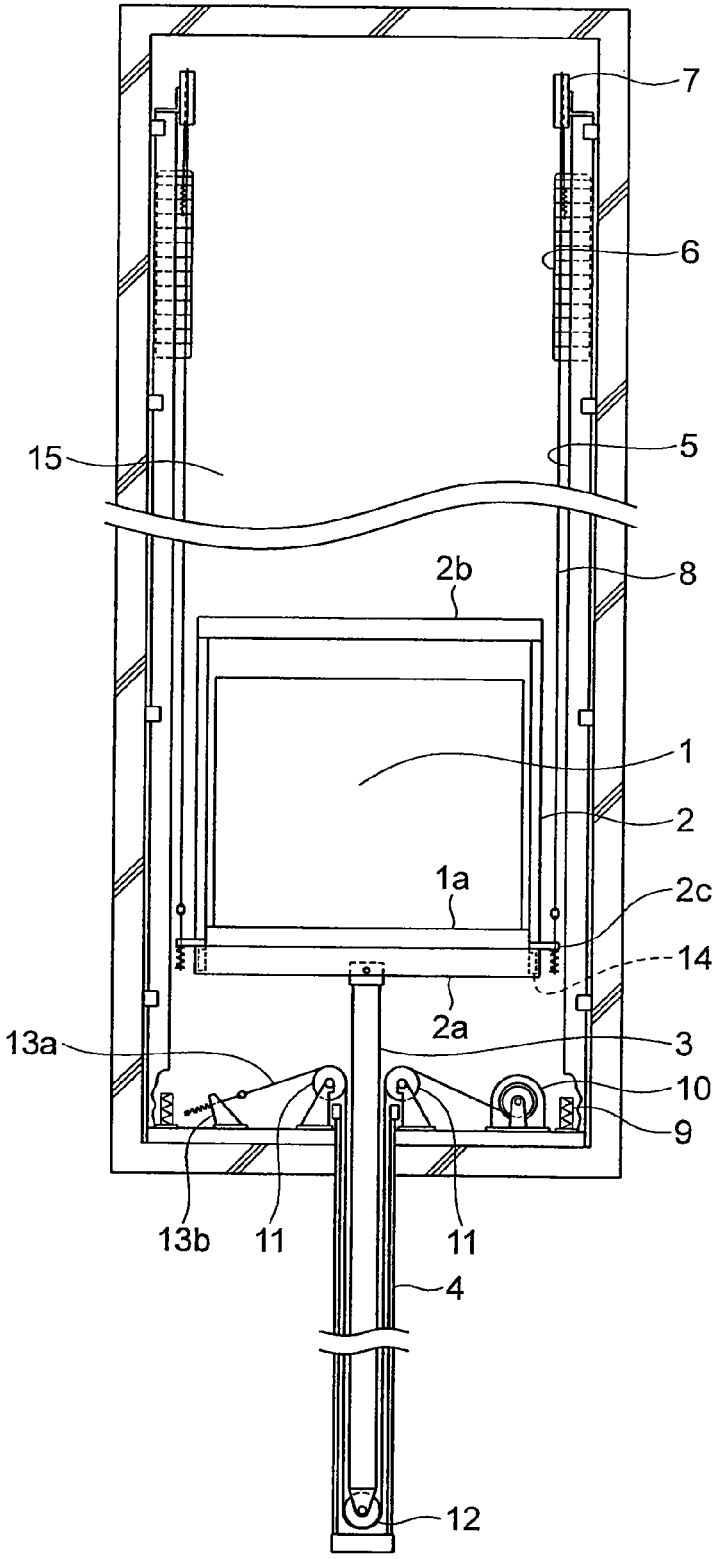
FIG. 1A longitudinal sectional view of a hoistway of a machine room-less rope elevator obtained by renovation according to a first embodiment of the present invention.

Embodiments of an elevator renovation method according to the present invention are hereinafter described referring to the accompanying drawings. In the drawings, the same reference symbol denotes the same or a corresponding part.

First Embodiment

Figure 2:
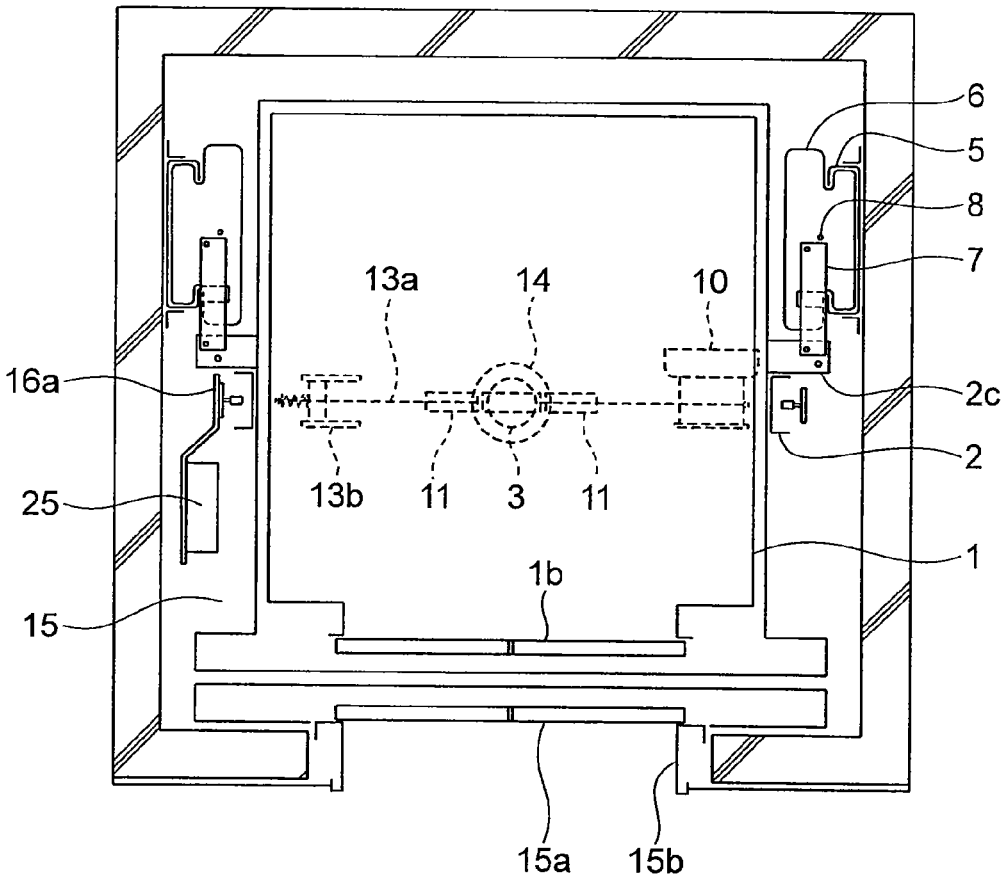
FIG. 2 A plane view of the hoistway illustrated in FIG. 1.
Figure 3:
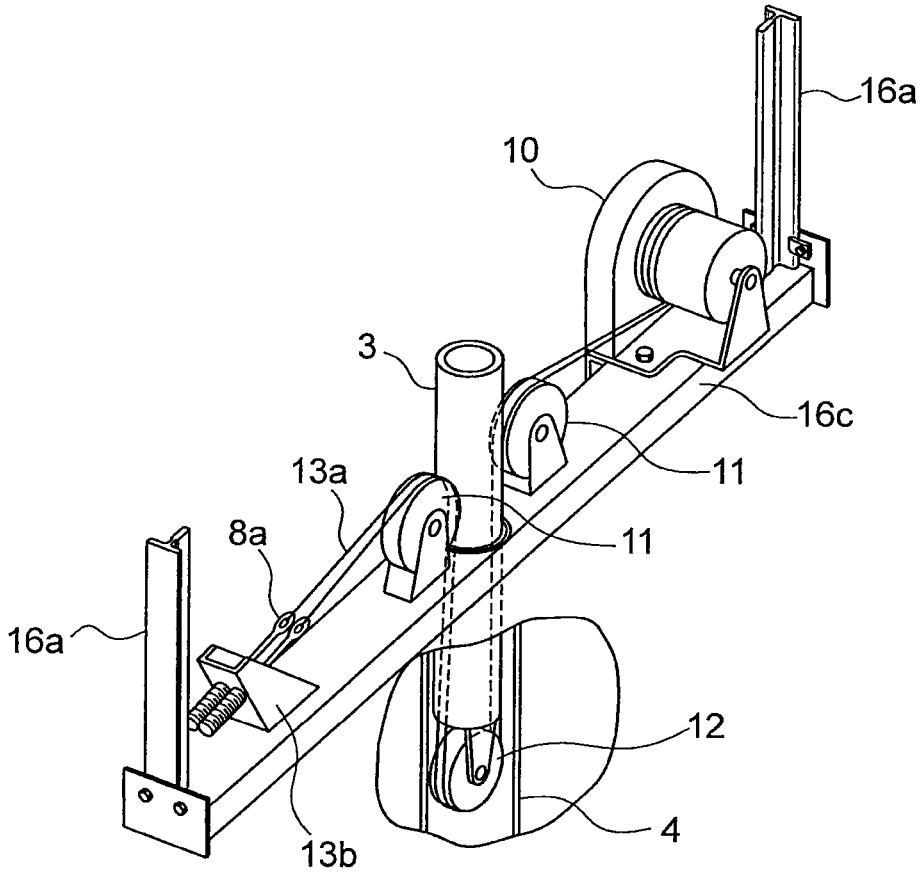
FIG. 3 A perspective view of a pit portion in the hoistway illustrated in FIG. 1.
Figure 4:
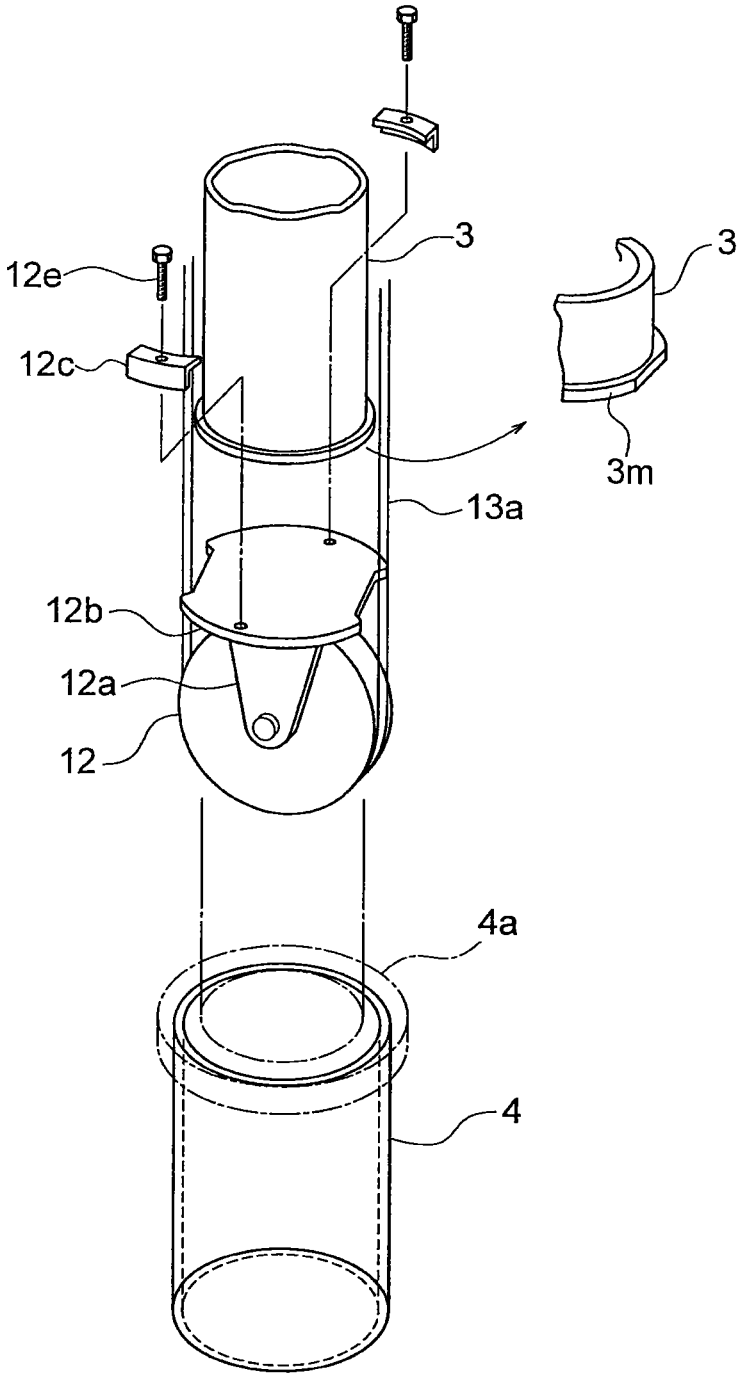
FIG. 4 A perspective view illustrating a state in which a return pulley is mounted to a lower end of a plunger.
Figure 5:
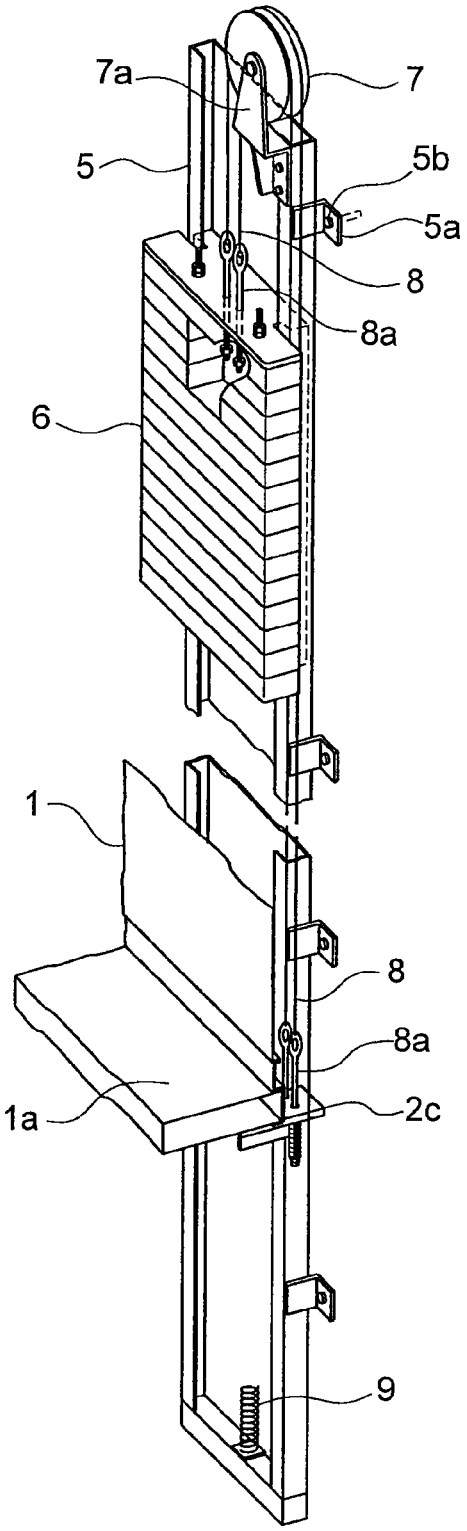
FIG. 5 A perspective view illustrating a state in which a counterweight is additionally mounted.
Figure 6:
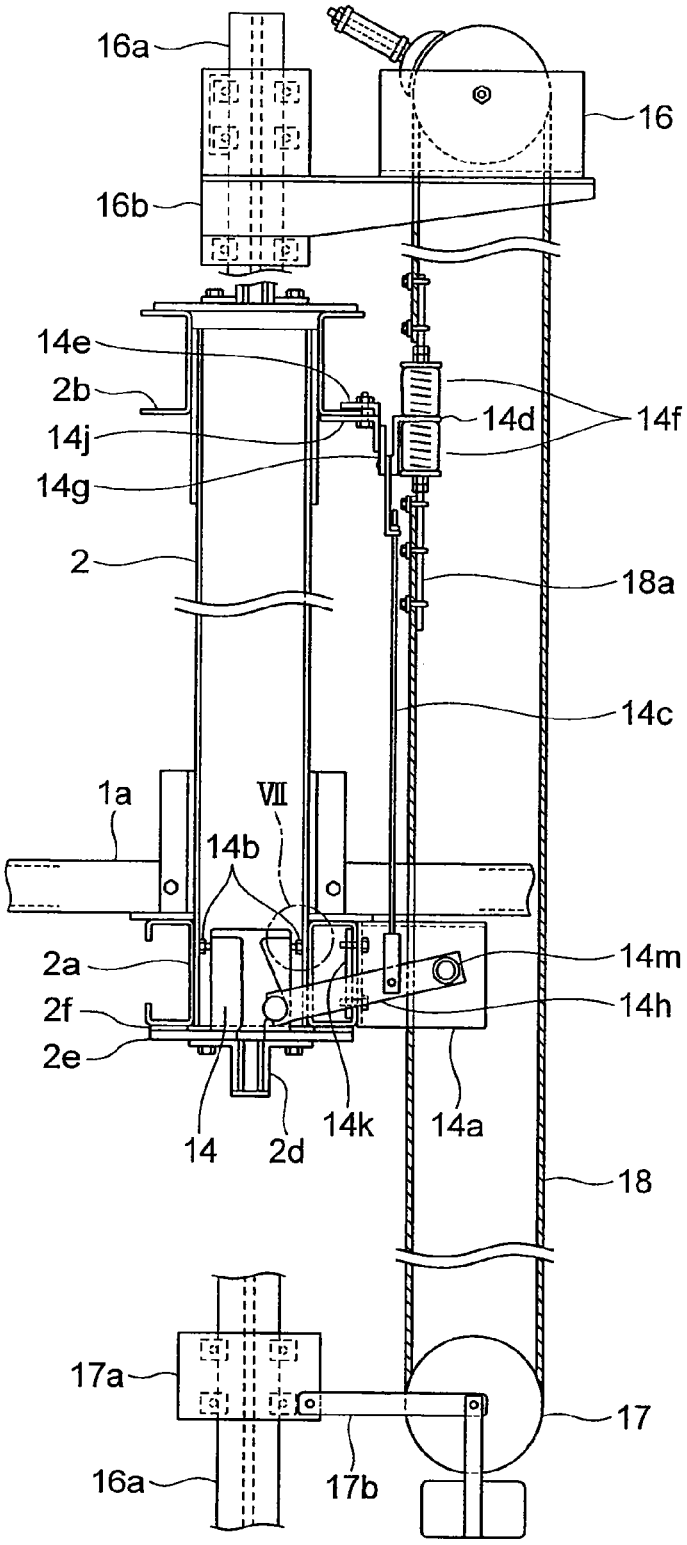
FIG. 6 A front view illustrating a configuration of an emergency stop, a governor, a tension sheave, and a governor rope.
Figure 7:
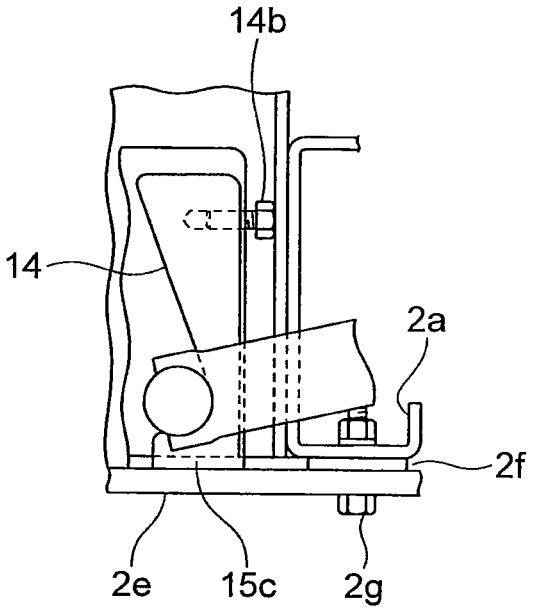
FIG. 7 A detailed diagram illustrating the vicinity of a portion VII of FIG. 6 in an enlarged manner.
Figure 8:
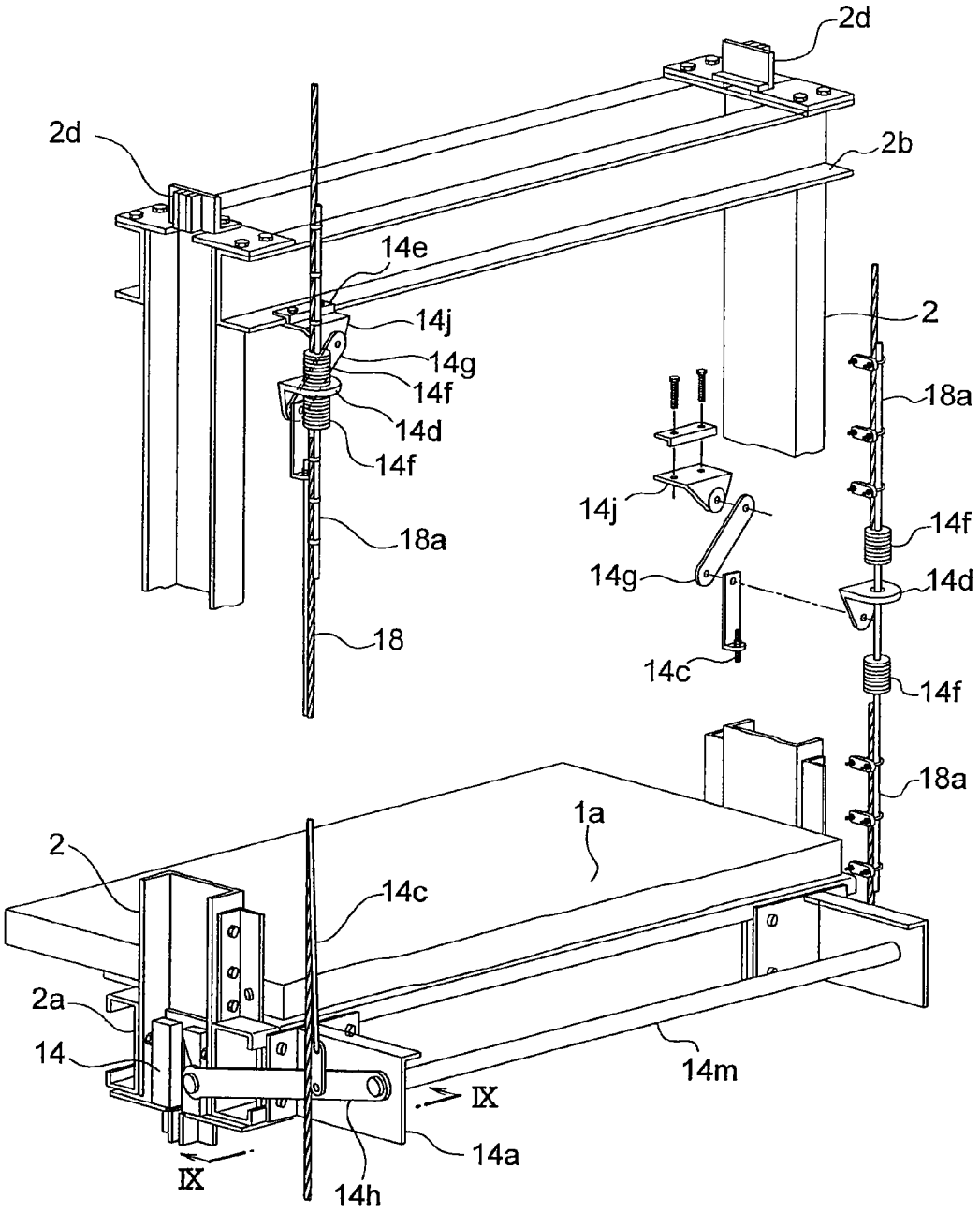
FIG. 8 A perspective view illustrating a portion between a crosshead and a plank illustrated in FIG. 6.
Figure 9:
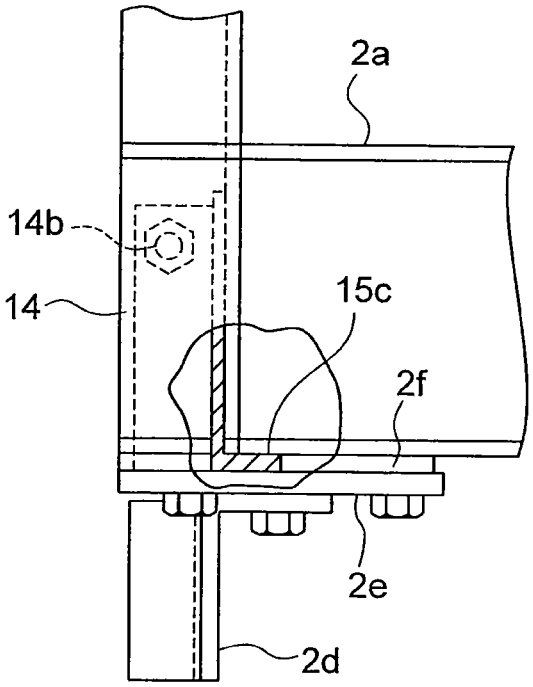
FIG. 9 A sectional view taken along the line IX-IX in FIG. 8.
Figure 10:
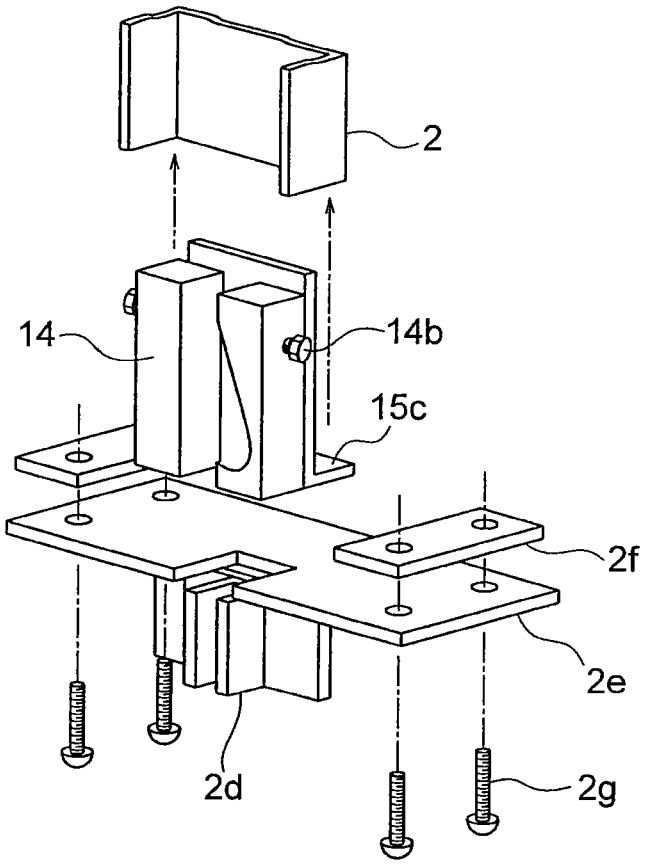
FIG. 10 An exploded perspective view of the emergency stop illustrated in FIG. 8.
Figure 11:
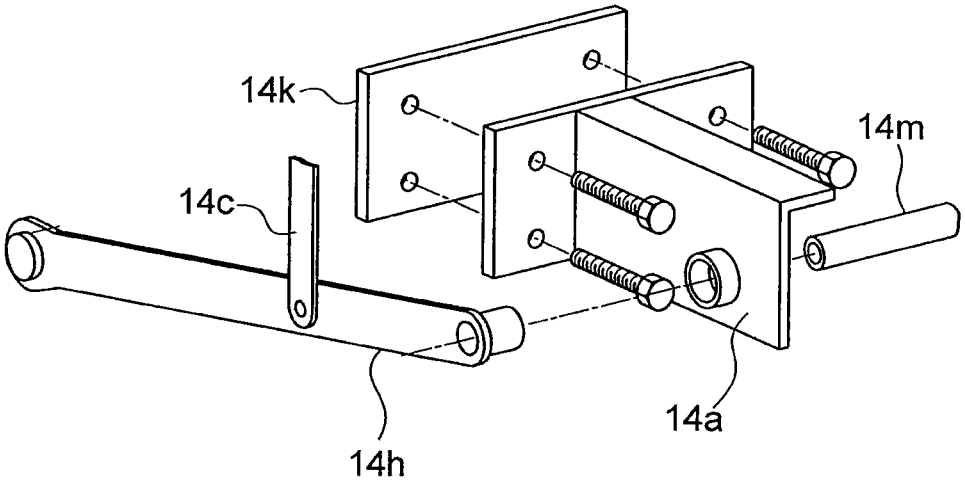
FIG. 11 An exploded perspective view of the vicinity of an actuating lever of the emergency stop illustrated in FIG. 8.
Figure 12:
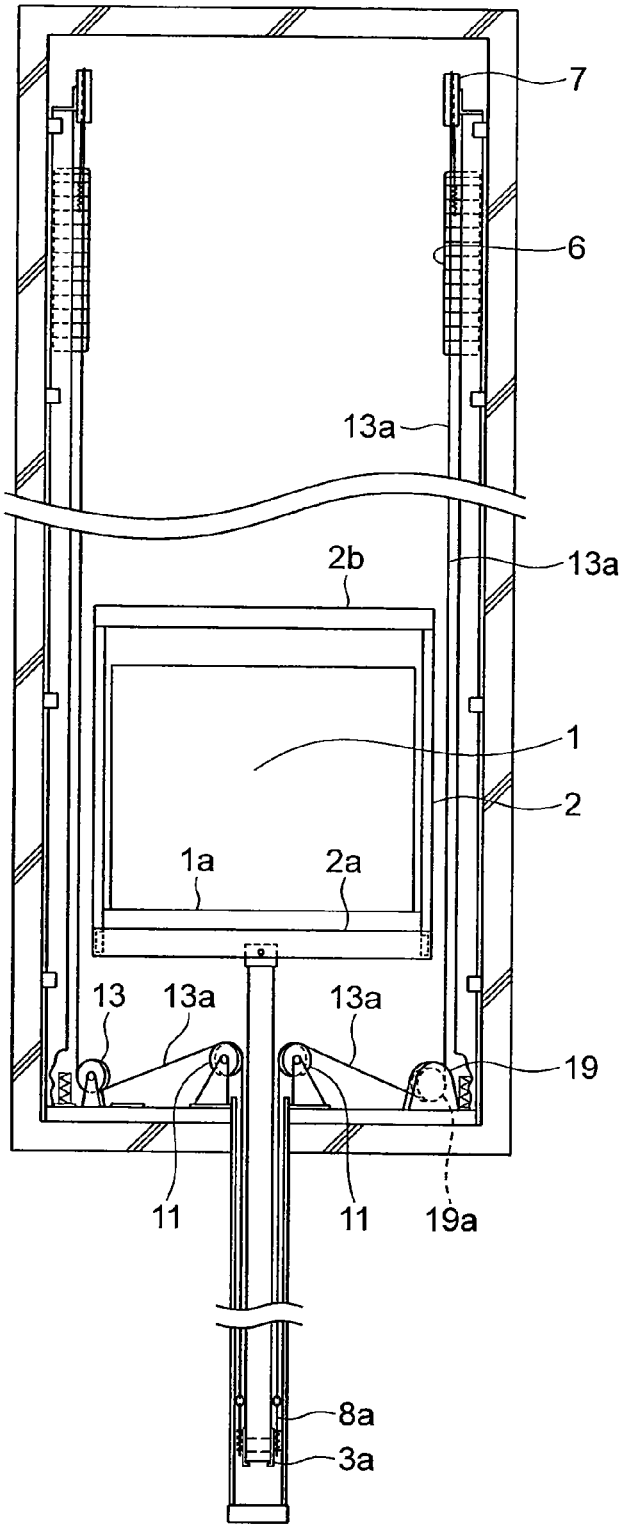
FIG. 12 A diagram equivalent to FIG. 1, according to a second embodiment of the present invention.
Figure 13:
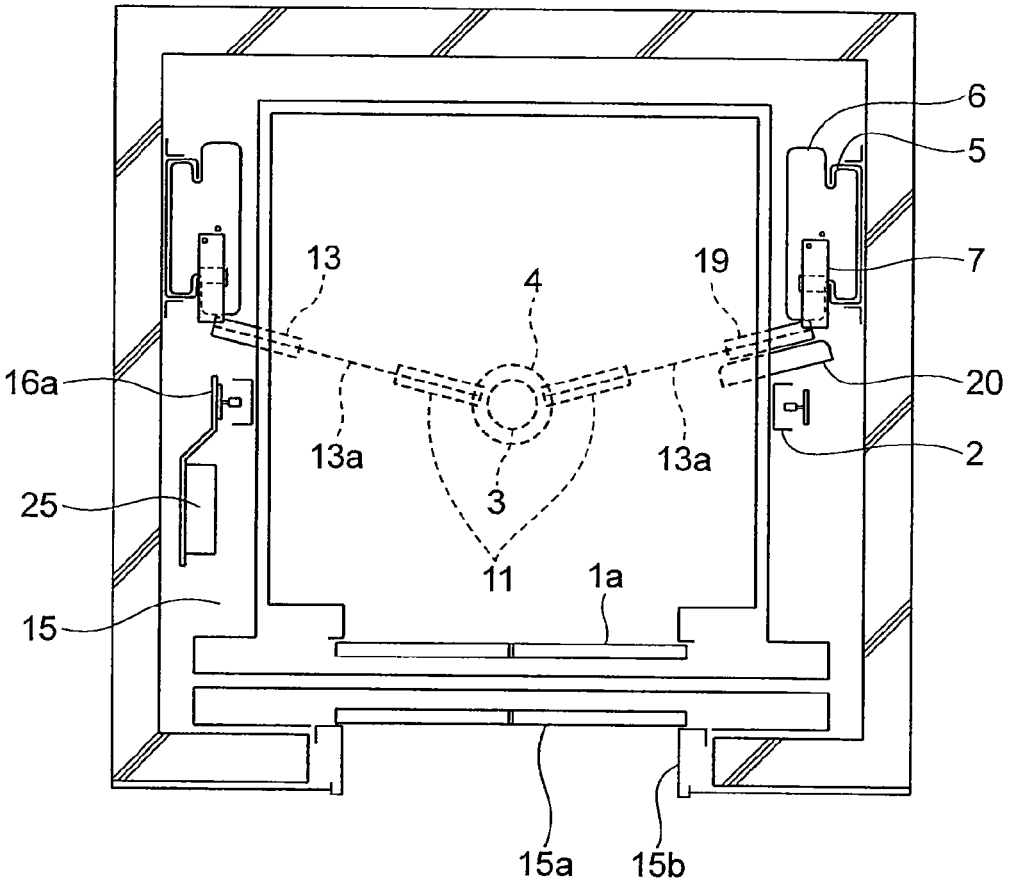
FIG. 13 A diagram equivalent to FIG. 2, according to the second embodiment.

A first embodiment describes a mode in which a hydraulic elevator referred to as a so-called "hydraulic direct plunger type elevator" in the field of art is renovated to a machine room-less rope elevator which is one of non-hydraulic elevators (elevators including a plunger driven by a force other than a hydraulic pressure of a jack). FIG. 1 is a longitudinal sectional view of a hoistway of a machine room-less rope elevator obtained by renovation according to the first embodiment, FIG. 2 is a plan view of the hoistway illustrated in FIG. 1, and FIG. 3 is a perspective view of a pit portion of the hoistway illustrated in FIG. 1. FIG. 4 is a perspective view illustrating a state in which a return pulley is mounted to a lower end of a plunger, and FIG. 5 is a perspective view illustrating a state in which a counterweight is additionally mounted. FIG. 6 is a front view illustrating a configuration of an emergency stop, a governor, a deflector sheave, and a governor rope. FIG. 7 is a detailed diagram illustrating a portion VII of FIG. 6 in an enlarged manner. FIG. 8 is a perspective view illustrating a portion between a crosshead and a plank illustrated in FIG. 6, FIG. 9 is a sectional view taken along the line IX-IX of FIG. 8, FIG. 10 is an exploded perspective view of the emergency stop illustrated in FIG. 8, and FIG. 11 is an exploded perspective view of the vicinity of an actuating lever of the emergency stop illustrated in FIG. 8.

In the hydraulic elevator before the renovation, a plunger 3 is provided integrally with a car 1 including a car floor 1*a* and car doors 1*b*. The plunger 3 extends downward from a bottom portion of the car 1. The plunger 3 is inserted into a jack 4 and is moved up by a hydraulic pressure of the jack 4. By the upward movement of the plunger 3, the car 1 is configured to be raised.

One of features of the elevator renovation method according to the present invention resides in that the plunger 3 and the jack 4 of the hydraulic elevator are not removed but are used as a part of devices included in the rope elevator. Specifically, the plunger 3 is left so as to be movable upward and downward inside the existing jack 4. Therefore, an oil draw out, a pipe, and a hydraulic driving portion (including a hydraulic tank, a pump, a motor, a control board, and the like), which are elements other than the plunger 3 and the jack 4, are removed.

On a buffer base 16*c* (buffer is not shown) provided in a pit, return pulleys 11, a rope stopper 13*b*, and a drum-type hoisting machine 10 are mounted as illustrated in FIG. 3. The drum-type hoisting machine 10 is one specific mode of a rope driving device prepared as an example of a driving device for generating a driving force for raising the car. The drum-type hoisting machine 10 pulls up the plunger by a hoisting rope described later.

Next, as illustrated in FIG. 4, a lid (oil-seal retention ring) 4*a* provided on an opening for the jack, which is provided in the center of the buffer base 16*c*, is removed from the opening for the jack. By a known winch (not shown), the plunger 3 is moved up together with the car 1 above the jack 4. Then, a return pulley 12 is mounted to a lower end of the plunger 3. As illustrated in FIG. 4, the return pulley 12 is supported on a lower surface of a mounting plate 12*b* through a bearing frame 12*a*, and is mounted to the lower end of the plunger 3 by a clip 12*c* and a bolt 12*e* through the mounting plate 12*b*. When a clearance between the plunger 3 and the jack 4, through which hoisting ropes 13*a* to be described later pass, is small at this time, a flange-like end portion of a bottom plate 3*m* of the plunger 3 may be scraped away by a sander or the like as partially shown in FIG. 4 as a reference. As described above, in a state in which the car 1 and the plunger 3 are lifted up above the jack 4, the hoisting ropes 13*a* are looped around the return pulley 12 mounted to the plunger 3. Shackles 8*a* provided to end portions of the hoisting ropes 13*a* are connected to the rope stopper 13*b*. In this manner, there is obtained a non-hydraulic elevator for exerting the driving force of the drum-type hoisting machine 10 which is the driving device in a direction of the upward movement of the plunger 3 to raise the car 1. Moreover, the car 1 can be lifted up together with the plunger 3 by the drum-type hoisting machine 10. In practice, however, a driving load is large. Therefore, counterweights 6 are mounted on both side surfaces of the car 1. The counterweights 6 are connected to the car 1 through compensating ropes. The counterweights and the car are raised and lowered in the directions opposite to each other.

The counterweights 6 provided on both sides of the car 1 are guided by a pair of counterweight guide rails 5, each made of a steel plate having an approximately C-like transverse cross section. Each of the counterweight guide rails 5 is fixed by brackets 5*a* mounted to hoistway walls by anchor bolts 5*b*, as illustrated in FIG. 5. When the hoistway walls do not have a concrete structure, the brackets can be welded and fixed to a structural iron frame of the hoistway. A weight buffer 9 is provided between lower ends of the pair of counterweight guide rails 5. The counterweight 6 is provided between the corresponding pair of the counterweight guide rails 5. A return pulley 7 is mounted to an upper end of the pair of counterweight guide rails 5 through an intermediation of a fitting 7*a*. Then, as illustrated in FIGS. 1 and 5, compensating ropes 8 are looped around the return pulley 7. The shackles 8*a* connected to one end of each of the compensating ropes 8 are connected to a rope stopper 2*c* provided to the car 1, whereas the shackles 8*a* connected to another end thereof are connected to the counterweight 6.

Next, as illustrated in FIGS. 6 to 10, the emergency stop device is mounted in the vicinity of one of guide shoes 2*d* provided to a lower part of a car frame 2. After a mount bolt for a guide-shoe mounting plate 2*e* provided to the lower part of the car frame 2 is removed, an emergency-stop main body 14 is inserted from a lower end of a column of the car frame. When an L-shaped emergency-stop back plate 15*c* of the emergency-stop main body 14 is interposed between the guide-shoe mounting plate 2*e* and a plank 2*a*, a spacer 2*f* is provided to a bolt hole portion. The degree of fastening of bolts 14*b* provided on both sides of the emergency-stop main body 14 is adjusted on the inner side of the column to perform positional adjustment of the emergency-stop main body 14 in a horizontal direction. By fastening bolts 2*g* through the guide-shoe mounting plate 2*e*, the emergency-stop main body 14 is supported.

As illustrated in FIGS. 6 and 11, a bearing fitting 14*a* and a screw seat 14*k* are provided so as to sandwich a flange portion of the plank 2*a* of the car frame 2 therebetween. By connecting the bearing fitting 14*a* and the screw seat 14*k* to each other by bolts, the bearing fitting 14*a* is fixed to the plank 2*a* of the car frame 2. An actuating lever 14*h* for an emergency-stop operation and a connecting shaft 14*m* are respectively connected to surfaces of the bearing fitting 14*a* on the sides opposite to each other.

A governor rope guide device (mounting plate) 14*j* is mounted to a lower part of a crosshead 2*b* of the car frame 2. The governor rope guide device 14*j* is connected to a clip 14*e* through a bolt in a mode in which the governor rope guide device 14*j* and the clip 14*e* sandwich the crosshead 2*b* therebetween.

In a top part of the hoistway 15, a governor device 16 is provided. On the other hand, a tension sheave 17 is provided in a lower part of the hoistway 15. The governor device 16 is supported through an intermediation of a governor mount base 16*b*, whereas the tension shave 17 is supported through an intermediation of a fitting 17*a* and an arm 17*b*. The governor mount base 16*b* and the fitting 17*a* are mounted to a car guide rail 16*a* by using clips and bolts.

A governor rope 18 passes from a governor rope gripper 14*d* provided to the car frame 2 through the tension sheave 17 and the governor 16 to return to the governor rope gripper 14*d* provided to the car frame 2 again. As an exploded state illustrated in FIG. 8, the governor rope gripper 14*d* is connected to the governor rope guide device 14*j* through an intermediation of a link 14*g*. Springs 14*f* are provided above and below the governor rope gripper 14*d*, respectively, whereas a rope fixing rod 18*a* is provided to extend above and below the governor rope gripper 14*d*. The governor rope gripper 14*d* and the lifting lever 14*h* of the emergency stop device are connected to each other by a connecting bar 14*c*.

After a new control board 25 is carried into the hoistway 15 and is mounted to the car guide rail 16*a* through fittings, various types of wirings are provided. Then, after adjustment of mounting of various types of hoistway switches and various types of adjustment for operating the elevator are performed, the renovation to the rope-type elevator is completed.

As described above, according to the elevator renovation method according to this embodiment, the jack and the plunger of the hydraulic elevator are not removed but are used as a part of the car devices. Thus, the jack and the plunger are not required to be disassembled and carried out. Therefore, a work period can be significantly reduced, while renovation cost for renovation to the machine room-less elevator can also be reduced. The above-mentioned advantage also brings about an advantage in that waste is reduced to reduce an environmental load. Moreover, it is sufficient that the hoisting machine for raising and lowering the car be provided in the vicinity of the jack and the plunger, that is, in the lower part of the hoistway (bottom portion). Therefore, even in the case where the top portion of the hoistway has no room for a space for providing a new hoisting machine and deflector sheave and further a space for providing the beams for supporting the hoisting machine and the deflector sheave, the hydraulic elevator can be renovated to the rope type elevator.

Second Embodiment

Next, a second embodiment of the present invention is described referring to FIGS. 12 to 15. FIGS. 12 to 15 are diagrams equivalent to FIGS. 1, 2, 3, and 5, respectively. The second embodiment is the same as the first embodiment described above except for a part to be described below.

Figure 14:
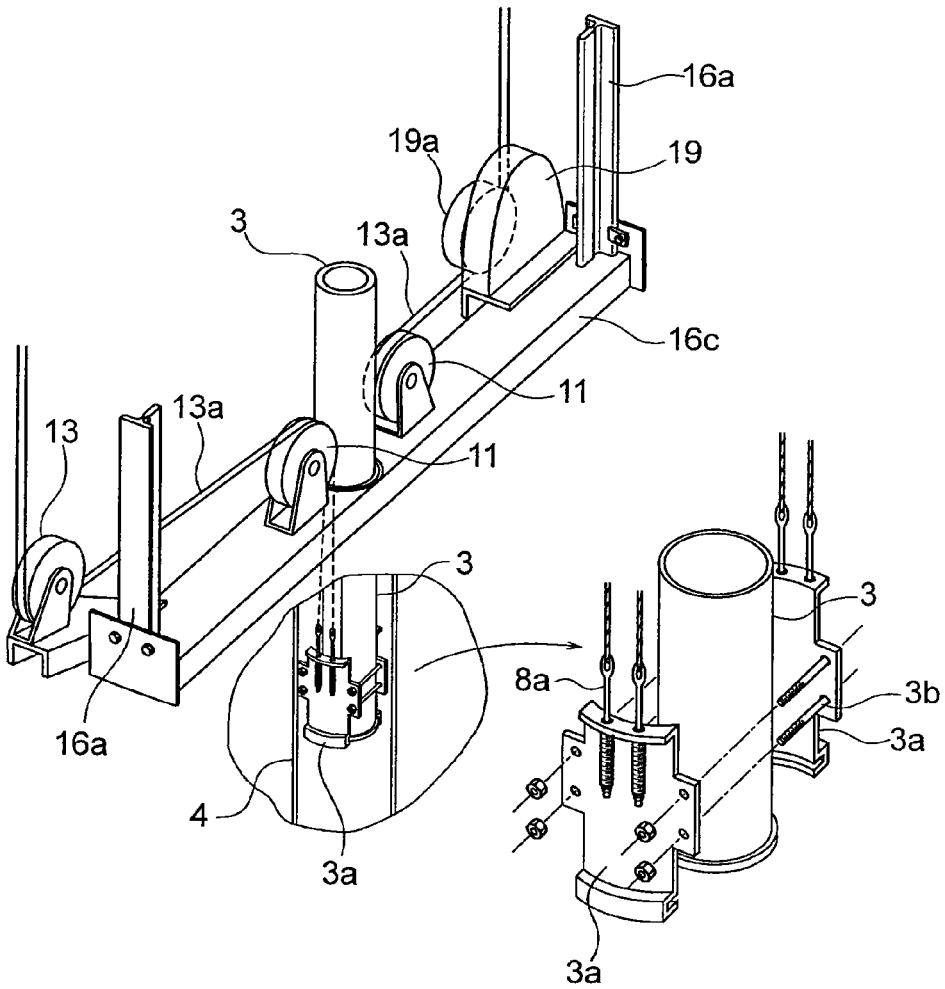
FIG. 14 A diagram equivalent to FIG. 3, according to the second embodiment.
Figure 15:
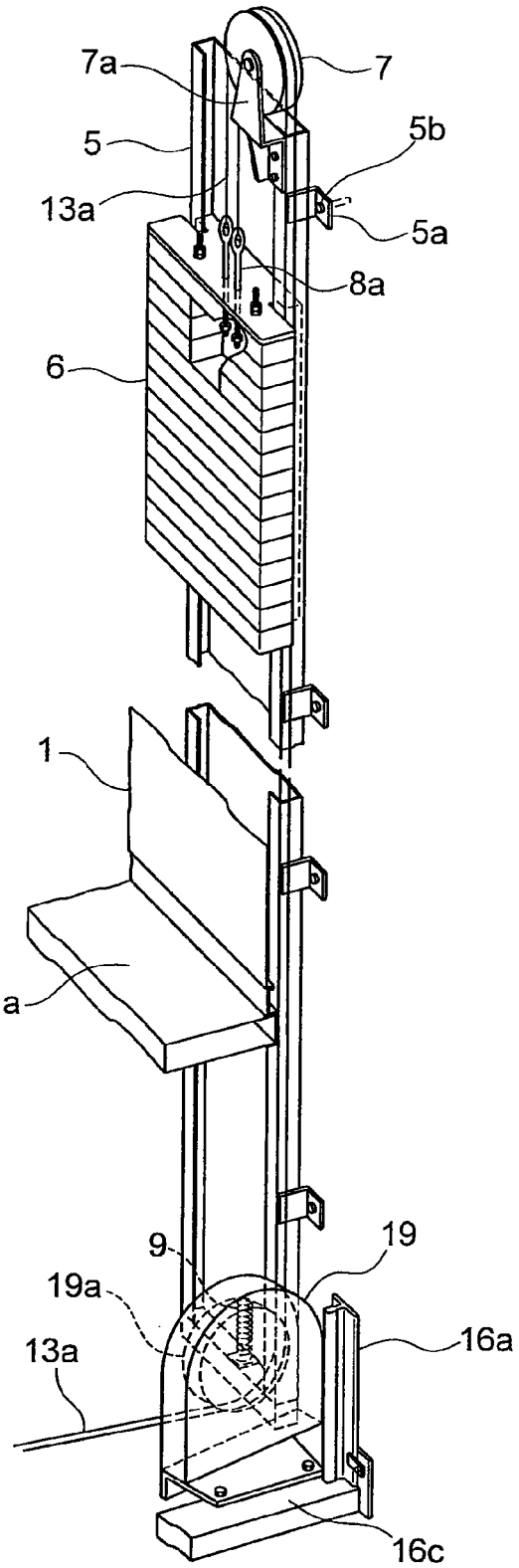
FIG. 15 A diagram equivalent to FIG. 5, according to the second embodiment.

As illustrated in FIG. 14, the pair of first return pulleys 11, a second return pulley 13, and a hoisting machine 19 are provided on the buffer base 16*c* (buffer is not shown) provided in the pit of the hoistway 15. The pair of first return pulleys 11 are respectively provided on both sides of the plunger 3. The second return pulley 13 is provided on the side of the plunger 3 opposite to the side where one of the first return pulleys 11 is provided. The hoisting machine 19 is provided on the side of the plunger 3 opposite to the side where another of the first return pulleys 11 is provided.

Next, the lid of the oil seal portion on the opening for the jack, which is provided in the center of the buffer base 16*c*, is removed. The plunger 3 is pulled up together with the car 1 by the winch, and is lifted up above the jack 4. A pair of rope stoppers 3*a* are connected to the plunger 3 by bolts 3*b* so that the rope stoppers 3*a* face and sandwich the plunger 3.

Subsequently, similarly to the first embodiment, the counterweight guide rails 5, the weight buffers 9, the counterweights 6, and the return pulleys 7 are mounted. The hoisting ropes 13*a* pass through one of the rope stoppers 3*a* of the plunger 3, one of the first return pulleys 11, the second return pulley 13, and further the return pulley 7 on the top of the counterweight guide rail 5 to be connected to one of the counterweight 6. On the opposite side, the hoisting ropes 13*a* pass through another of the rope stoppers 3*a* of the plunger, another of the return pulleys 11, a sheave 19*a* of the hoisting machine 19, and further the return pulley 7 on the top of another of the counterweight guide rails 5 in a similar manner to be connected to another of the counterweights 6. By providing the hoisting ropes 13*a* in this manner, the car 1 can be raised and lowered by a driving force of the hoisting machine 19.

Further, as in the case of the first embodiment, the emergency stop device and associated components, the governor, the tension sheave, and the governor rope are mounted. Finally, as in the case of the first embodiment, after the new control board 25 is carried into the hoistway 15 and is mounted to the car guide rail 16*a* through the fittings, various wirings are provided. Then, after adjustment of mounting of various types of hoistway switches and various types of adjustment for operating the elevator are performed, the renovation to the rope-type elevator is completed.

Even according to the second embodiment described above, similarly to the first embodiment, when the existing hydraulic elevator is renovated to the rope-type elevator, the renovation period can be reduced, while the space can be efficiently used.

Third Embodiment

Figure 16:
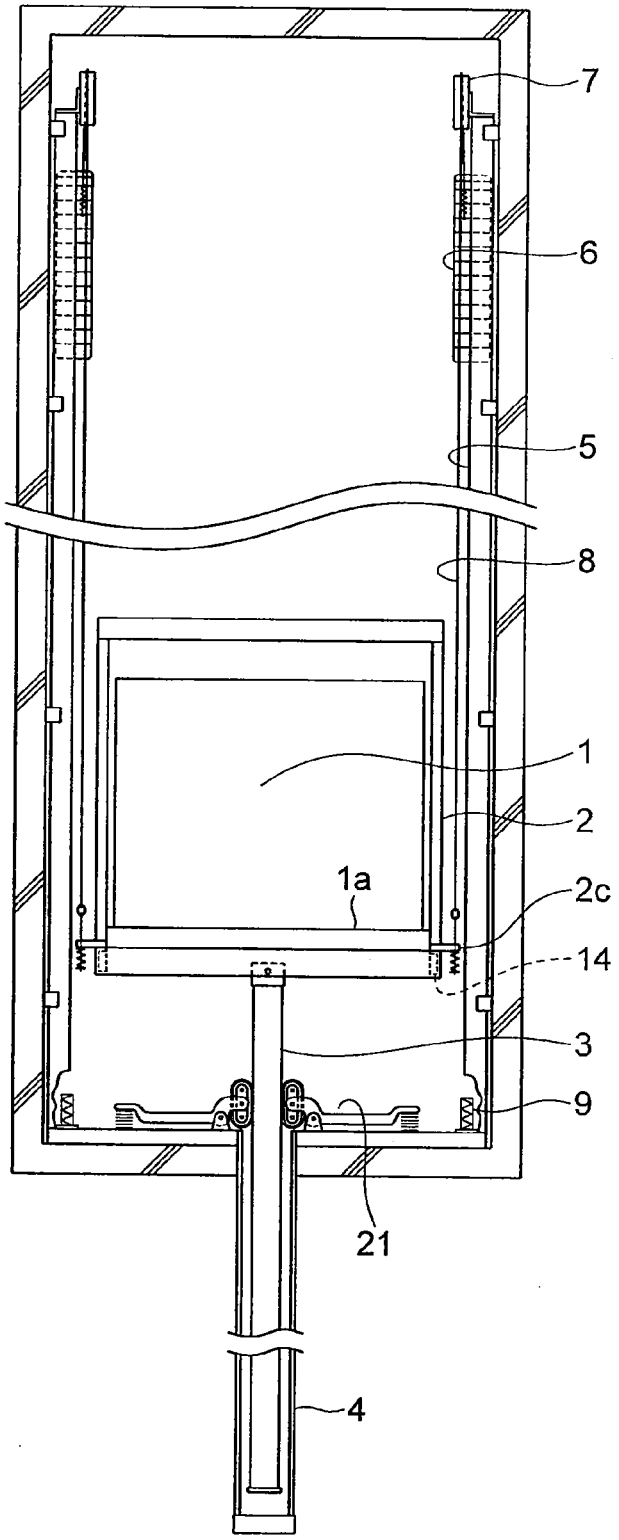
FIG. 16 A diagram equivalent to FIG. 1, according to a third embodiment of the present invention.
Figure 17:
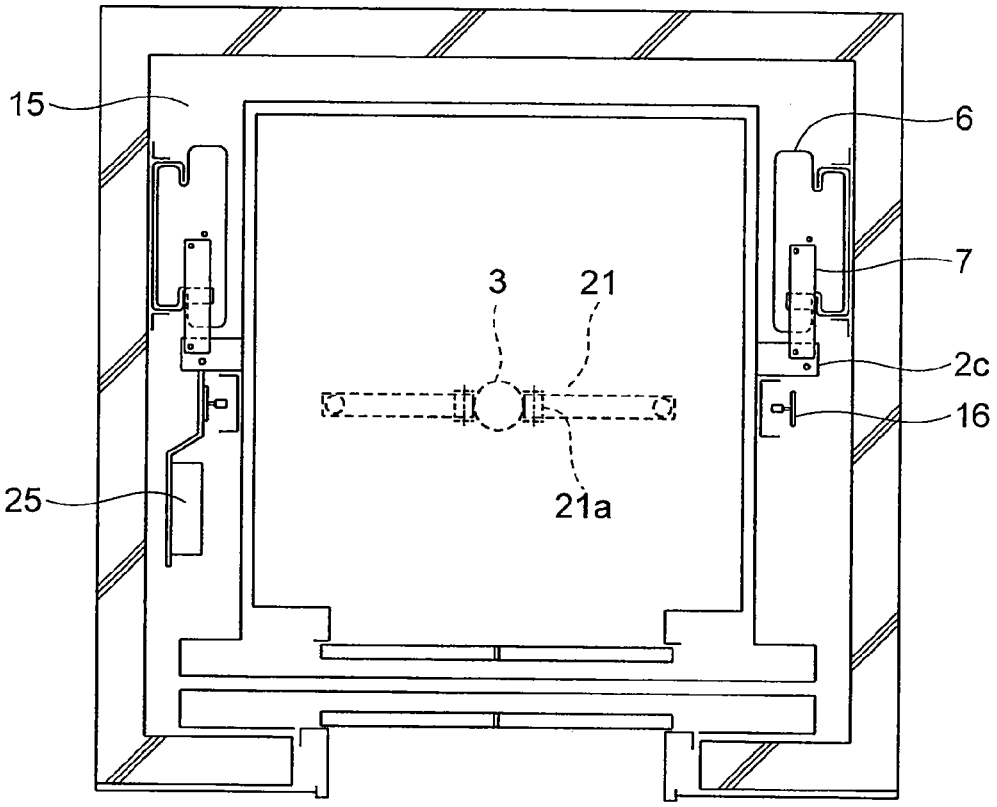
FIG. 17 A diagram equivalent to FIG. 2, according to the third embodiment.
Figure 18:
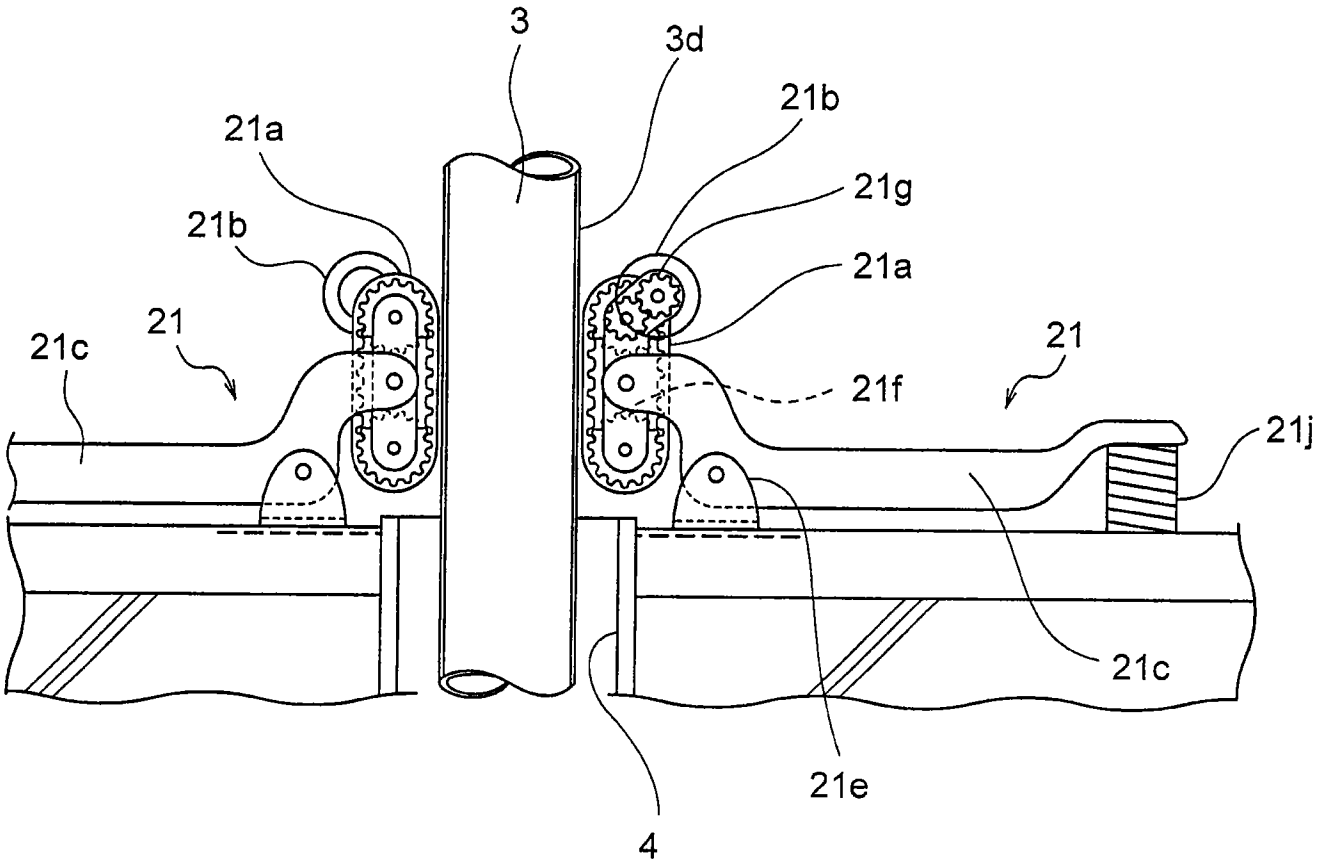
FIG. 18 A front view illustrating a state in which pressure-driving belt devices are mounted to a plunger provided in the pit portion of the hoistway.
Figure 19:
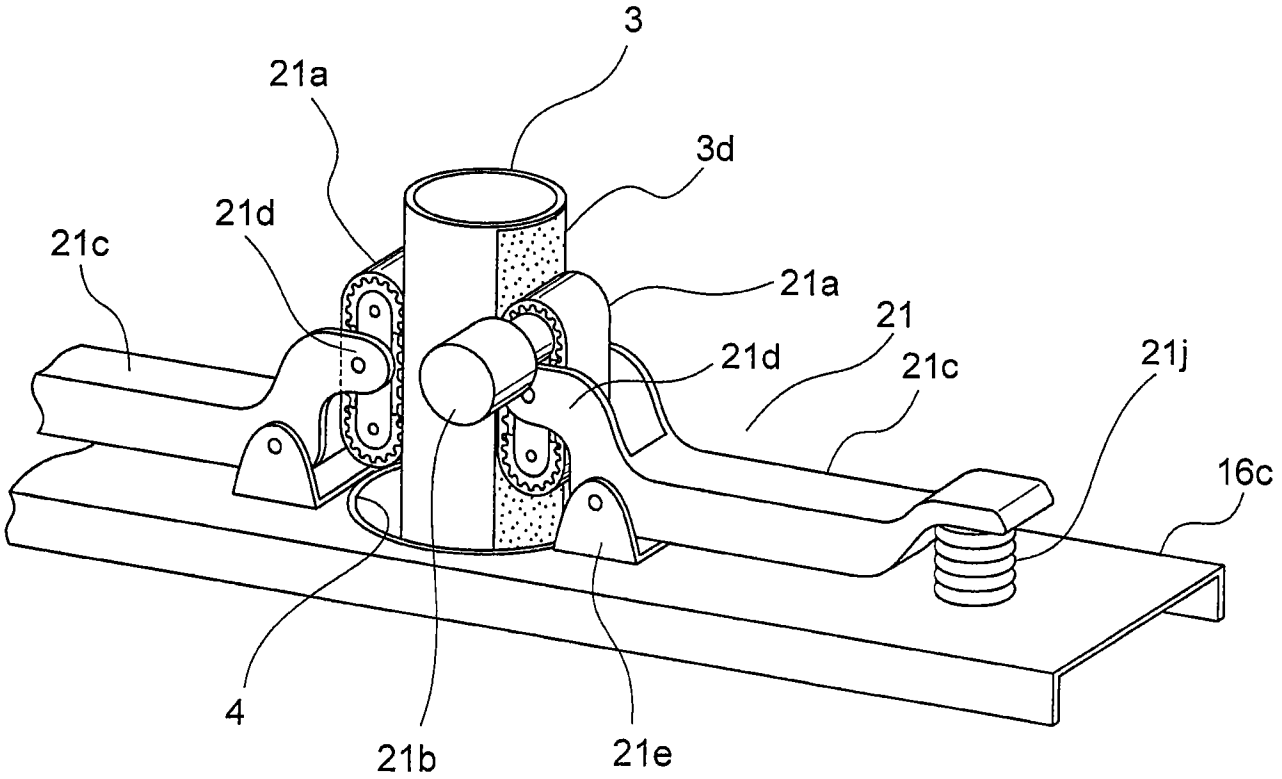
FIG. 19 A perspective view of FIG. 18.
Figure 20:
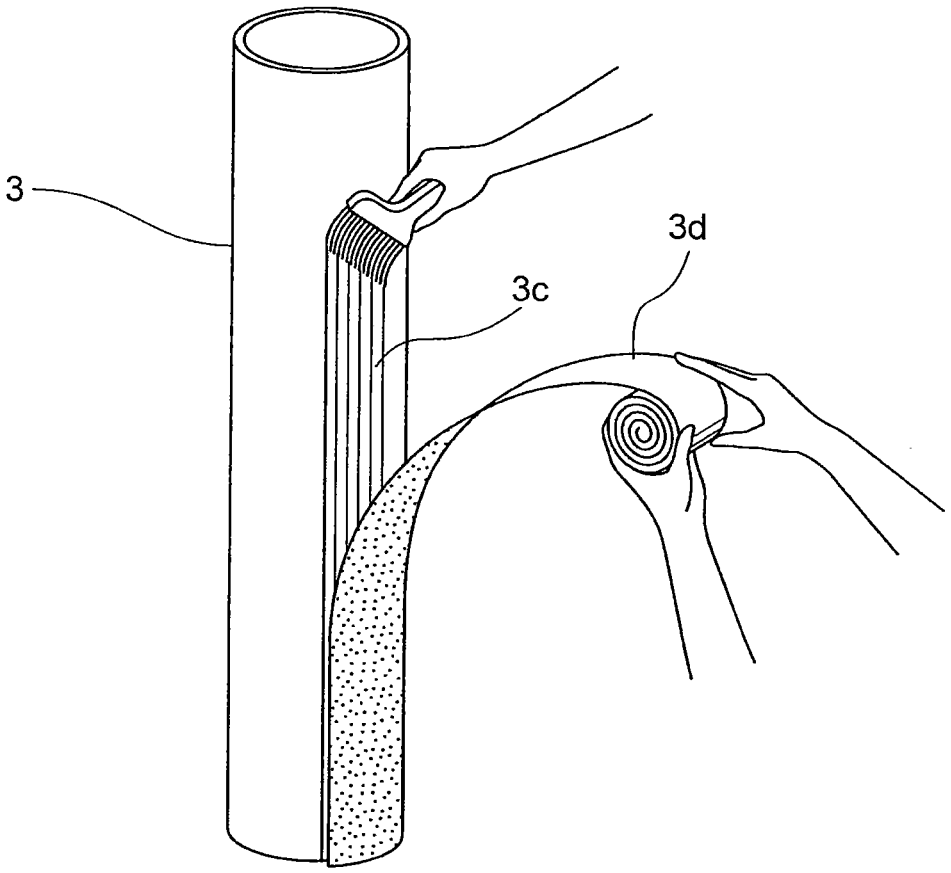
FIG. 20 A diagram illustrating a first mode of a rough surface provided to the plunger.
Figure 21:
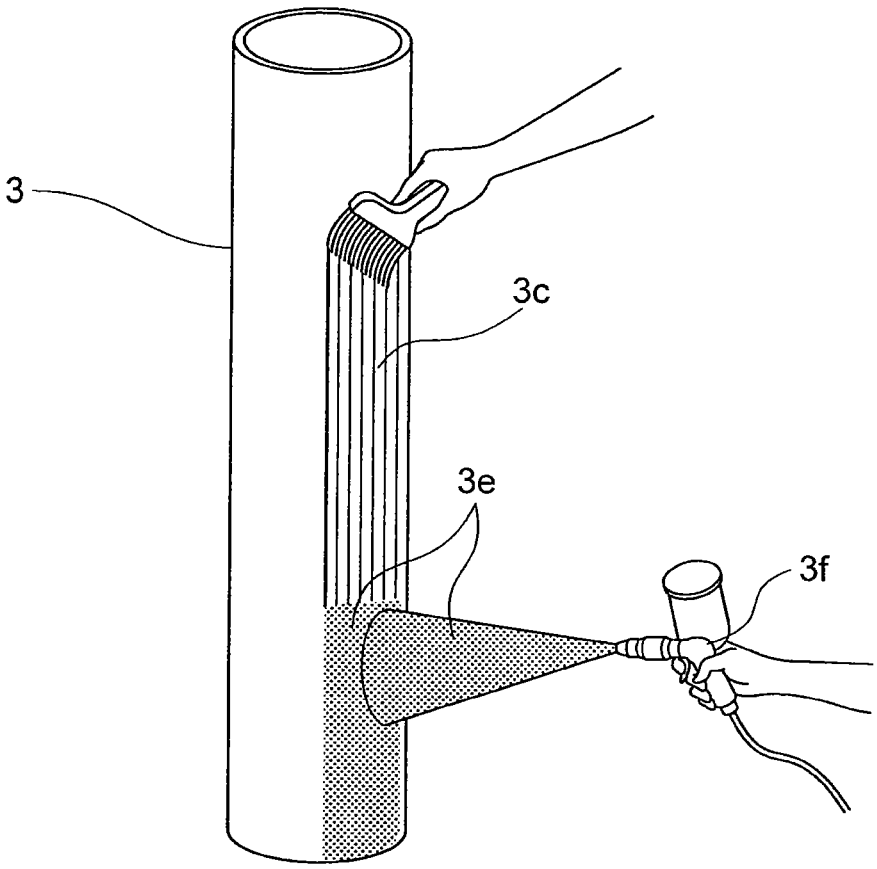
FIG. 21 A diagram illustrating a second mode of the rough surface.
Figure 22:
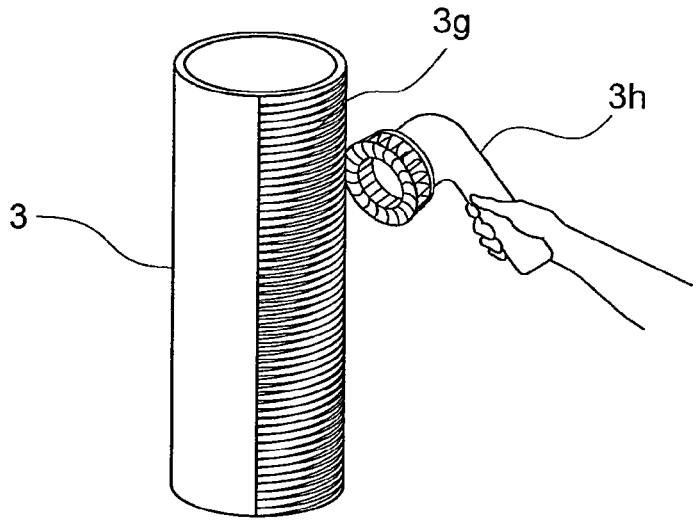
FIG. 22 A diagram illustrating a third mode of the rough surface.
Figure 23:
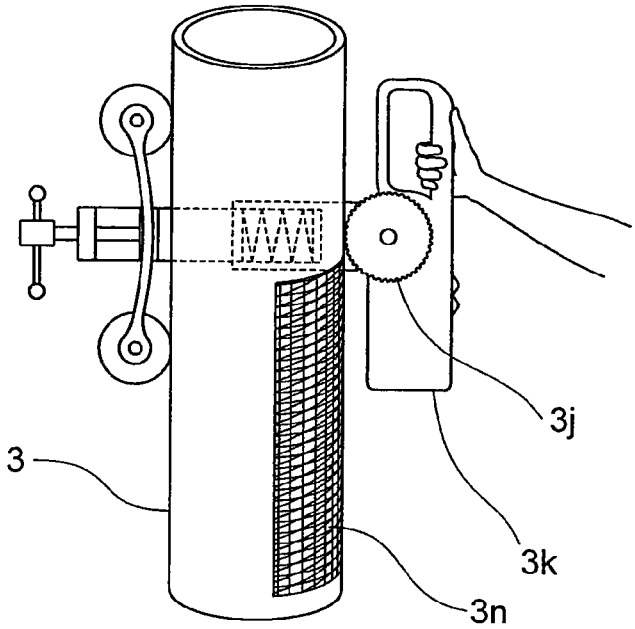
FIG. 23 A diagram illustrating a fourth mode of the rough surface.

Next, as a third embodiment of the present invention, a of renovating a hydraulic direct plunger type elevator to a pressure-driven elevator is described referring to FIGS. 16 to 23. FIGS. 16 and 17 are diagrams equivalent to FIGS. 1 and 2, respectively. FIG. 18 is a front view illustrating a state in which pressure-driving belt devices are mounted to the plunger provided in the pit portion of the hoistway, and FIG. 19 is a perspective view of FIG. 18. Further, FIG. 20 is a diagram illustrating a first mode of a rough surface provided to the plunger, FIG. 21 is a diagram illustrating a second mode of the rough surface provided to the plunger, FIG. 22 is a diagram illustrating a third mode of the rough surface provided to the plunger, and FIG. 23 is a diagram illustrating a fourth mode of the rough surface provided to the plunger. The third embodiment is the same as the first embodiment described above except for a part to be described below.

As illustrated in FIGS. 18 and 19, at least two pressure-driving belt devices 21 are provided to the buffer base 16*c* (buffer is not shown) provided in the pit. The pressure-driving belt devices 21 are prepared as an example of a driving device for generating a driving force for raising the car. The pressure-driving belt devices 21 move up the plunger by a friction force.

In the illustrated example, the two pressure-driving belt devices 21 are mounted so as to be pressed against the plunger 3 from the opposite sides. Each of the pressure-driving belt devices 21 includes a neck portion 21*d* at one end portion of an elongated arm 21*c* (end portion on the side closer to the plunger 3). Each of the neck portions 21*d* stands obliquely upward toward the plunger 3. A driving belt 21*a* (having a cogged-belt shape) is rockably supported by each of the neck portions 21*d*. A driving motor 21*b* is connected to each of the driving belts 21*a*. Each of the driving belts 21*a* is driven to be circulated by a driving force of the driving motor 21*b*, which is transferred through a reduction gear 21*g* and a cogged gear 21*f*. A spring 21*j* is provided to a lower surface of another end portion of each of the arms 21*c*. Further, a supporting portion 21*e* is provided to a portion of each of the arms 21*c*, which is closer to the one end. Each of the arms 21*c* is supported by the corresponding supporting portion 21*e* so as to be inclined in a seesaw-like fashion.

With the configuration described above, the pressure-driving belt devices 21 can press the driving belts 21*a* so as to bring the driving belts 21*a* in pressure contact with the pressure-driving belt devices 21 with a strong force based on the principle of leverage. Moreover, each of the driving belts 21*a* has the cogged belt-like shape, and therefore does not slip against the cogged gear 21*f*. Further, rough surfaces are provided on portions of a surface of the plunger 3, which are to be held in pressure contact with the driving belts 21*a*. Specifically, as a first mode of the rough surface, an adhesive 3*c* is applied onto the portions of the surface of the plunger 3, which are to be held in pressure contact with the driving belts 21*a*. Then, vertically extending band-like sheets of abrasive paper 3*d* are bonded thereon. By the abrasive paper 3*d*, the friction force between the driving belts 21*a* and the plunger 3 is increased to reduce the slippage between the driving belts 21*a* and the plunger 3. By the above-mentioned manner, the driving force of the pressure-driving belt devices 21 can be economically and reliably transferred to the plunger 3 to raise and lower the plunger 3, that is, to raise and lower the car 1.

The rough surfaces provided to the portions of the surface of the plunger 3, which are to be held in pressure contact with the driving belts 21*a*, are not limited to the mode using the abrasive paper 3*d*. Thus, the following modes can be described as other examples. As a second mode of the rough surface as illustrated in FIG. 21, the adhesive 3*c* is applied onto the portions of the surface of the plunger 3, which are to be held in pressure contact with the driving belts 21*a*. Then, sand particles 3*e* are sprayed to adhere thereon by using a spray 3*f*. Alternatively, as a third embodiment of the rough surface, as illustrated in FIG. 22, sander lines 3*g* may be formed on the portions of the surface, which are to be held in pressure contact with the driving belts 21*a*, by a sander 3*h*. Further, alternatively, as a fourth mode of the rough surface, as illustrated in FIG. 23, a knurling pattern 3*n* may be formed on the portions of the surface, which are to be held in pressure contact with the driving belts 21*a*, by using a knurling blade 3*j* of a knurling tool 3*k*.

The configuration other than that described above and the other removal and installation work and adjustment work are the same as those described in the above-mentioned first embodiment.

Even according to the third embodiment described above, similarly to the first embodiment, when the existing hydraulic elevator is renovated to the rope-type elevator, the renovation period can be reduced, while the space can be efficiently used.

Fourth Embodiment

Figure 24:
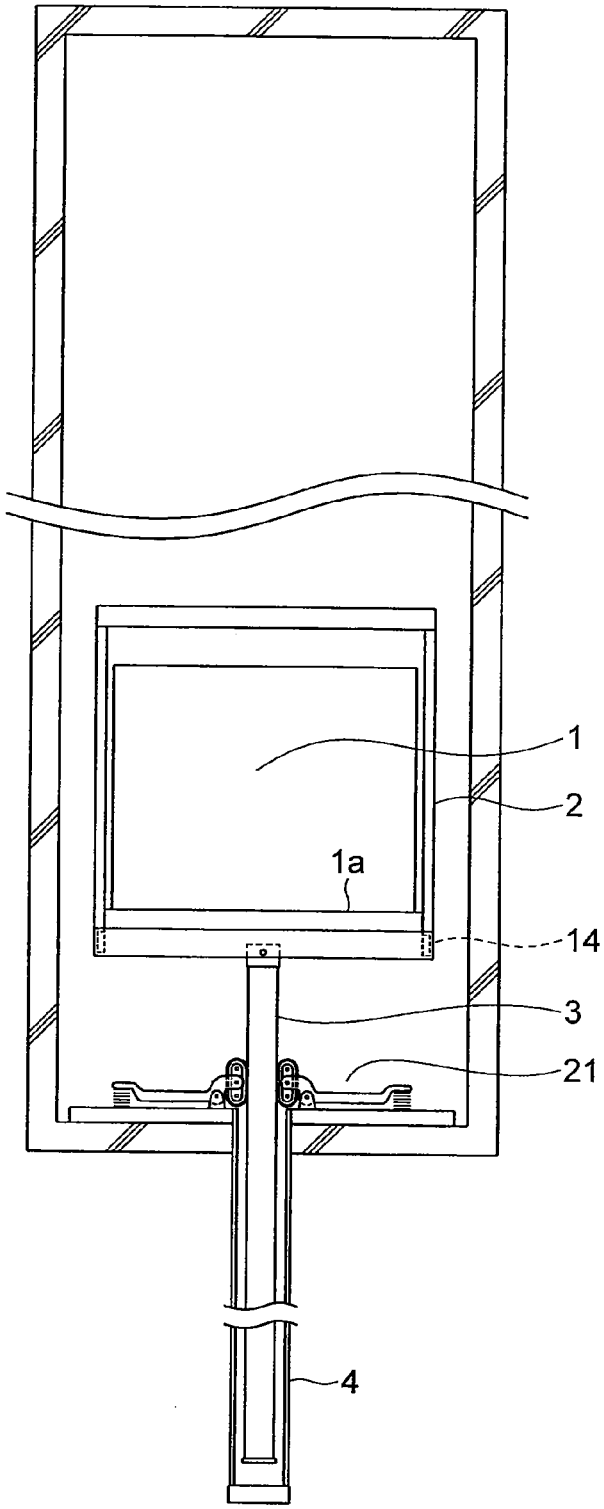
FIG. 24 A diagram equivalent to FIG. 16, according to a fourth embodiment of the present invention.
Figure 25:
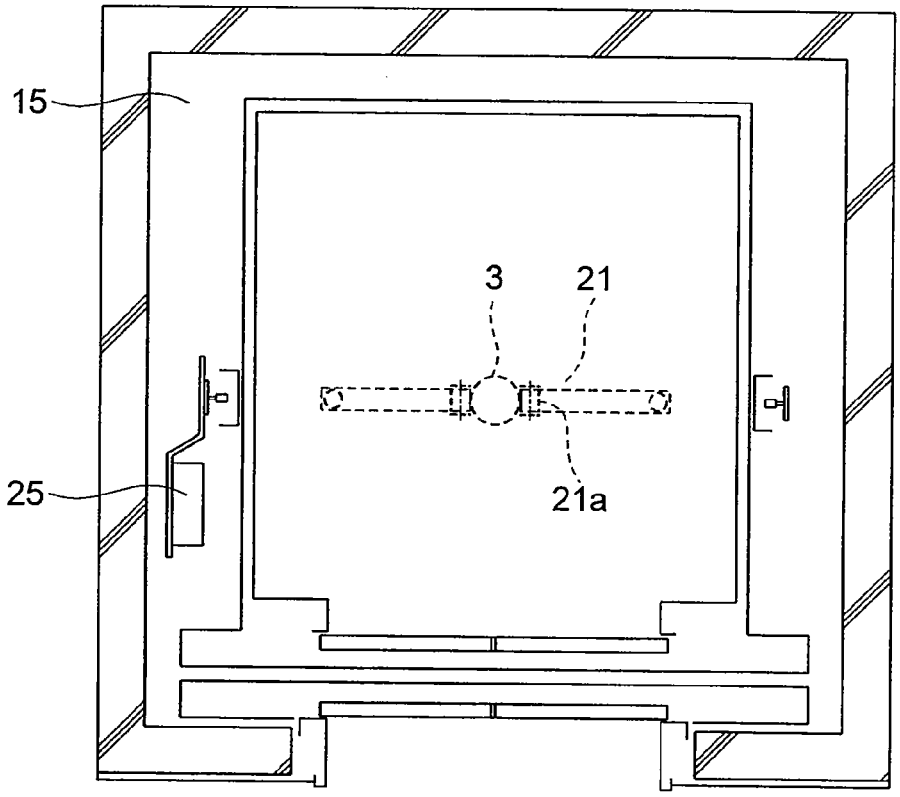
FIG. 25 A diagram equivalent to FIG. 17, according to the fourth embodiment.

The pressure-driven elevator obtained by the renovation of the hydraulic direct plunger type elevator is not limited to include the counterweights as described in the above-mentioned third embodiment. A configuration illustrated in FIGS. 24 and 25 as a fourth embodiment is an example thereof. As illustrated in FIGS. 24 and 25, similarly to the above-mentioned third embodiment, the plunger 3 of the pressure-driven elevator is used, while the pressure-driving belt devices 21 are additionally provided in the fourth embodiment. However, the fourth embodiment differs from the third embodiment in that the configuration associated with the counterweights, such as the counterweights 6, the counterweight guide rails 5, the return pulleys 7, the compensating ropes 8, and the weight buffers 9, is not installed. The remaining configuration, and the other removal and installation work and adjustment work are the same as those described in the above-mentioned first embodiment.

Even according to the fourth embodiment described above, similarly to the first embodiment, when the existing hydraulic elevator is renovated to the rope-type elevator, the renovation period can be reduced, while the space can be efficiently used.

The contents of the present invention have been specifically described above referring to the preferred embodiments. However, it is apparent that various modified modes are possible by those skilled in the art based on the basic technological thought and teaching of the present invention.

REFERENCE SIGNS LIST

1 car, 3 plunger, 4 jack, 6 counterweight, 8 compensating rope, 10 drum-type hoisting machine (driving device), 13*a* hoisting rope, 15 hoistway, 21 pressure-driving belt device (driving device)

The invention claimed is:

1. An elevator renovation method for renovating a hydraulic elevator in which a plunger provided integrally with a car is hydraulically driven to a non-hydraulic elevator, comprising:

providing a driving device that generates a driving force for raising the car, the driving device being provided in a bottom portion of a hoistway;

leaving the plunger so that the plunger that is provided integrally with the car extends downward from a bottom portion of the car, and the plunger can be raised and lowered inside an existing jack; and obtaining the non-hydraulic elevator by exerting the driving force of the driving device to the plunger so that the plunger is raised and lowered inside an existing jack to directly raise and lower the car.

2. An elevator renovation method according to claim 1, wherein:

the driving device comprises a rope driving device; and the plunger is configured to be lifted up by a hoisting rope driven by the rope driving device.

3. An elevator renovation method according to claim 2, wherein:

the hoisting rope driven by the rope driving device is configured to extend around a pulley mounted to a lower end of the plunger opposite to an end integrally provided with the car.

4. An elevator renovation method according to claim 1, wherein:

the driving device comprises a plurality of pressure-driving belt devices mounted so as to be pressed against the plunger from opposite sides; and the plunger is configured to be lifted up by a friction force generated by the contact between the plurality of pressure-driving belt devices and the plunger.

5. An elevator renovation method according to claim 1, further comprising a counterweight, wherein:

the counterweight is connected to the car through an intermediation of a compensating rope; and the counterweight and the car are raised and lowered in opposite directions.

* * * * *